US006691785B2

(12) United States Patent
Patel

(10) Patent No.: US 6,691,785 B2
(45) Date of Patent: Feb. 17, 2004

(54) ISOLATION VALVE

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 46 days.

(21) Appl. No.: 09/930,689

(22) Filed: Aug. 15, 2001

(65) Prior Publication Data

US 2002/0029890 A1 Mar. 14, 2002

Related U.S. Application Data

(60) Provisional application No. 60/228,688, filed on Aug. 29, 2000.

(51) Int. Cl.[7] ..... E21B 34/10
(52) U.S. Cl. ..... 166/375; 166/386; 166/321
(58) Field of Search ..... 166/386, 375, 166/319, 321, 331, 240

(56) References Cited

U.S. PATENT DOCUMENTS 4,258,786 A * 3/1981 Lochte et al. ..... 166/72
5,529,126 A * 6/1996 Edwards ..... 166/331
6,302,210 B1 * 10/2001 Crow et al. ..... 166/324
2002/0074129 A1 * 6/2002 Moore ..... 166/375

* cited by examiner

*Primary Examiner*—David Bagnell
*Assistant Examiner*—Jennifer R. Dougherty
(74) *Attorney, Agent, or Firm*—Trop, Pruner & Hu, P.C.; Jeffrey E. Griffin; Brigitte L. Echols

(57) ABSTRACT

A downhole valve that may be opened and closed by alternatingly pressurizing/bleeding a first control line, which is in fluid communication with a first surface of an activating member, and a second control line, which is in fluid communication with a second surface of the activating member. The fluid within the control lines is the same density as the fluid found in the annulus of the wellbore. The development of a leak in the control lines therefore does not by itself result in the actuation or movement of the activating member or valve member.

38 Claims, 8 Drawing Sheets

ISOLATION VALVE

CROSS-REFERENCE TO RELATED APPLICATION

This claims the benefit under 35 U.S.C. § 119(e) of U.S. Provisional Application Ser. No. 60/228,688, filed Aug. 29, 2000.

BACKGROUND

This invention generally relates to downhole tools, namely subsurface safety valves.

Safety regulations exist that require the placement of two mechanical pressure containment barriers at all times between the produced fluids in a wellbore and the environment. In subsea completions, when the blow out preventer or tree is removed, it has been general practice to close the surface controlled subsurface safety valve and install a tubing hanger plug by wireline prior to the removal thereby fulfilling the two barrier requirement. However, operators would rather not perform wireline interventions since they are generally costly, time-consuming, and invasive. The prior art would therefore benefit from a pressure barrier mechanism that fulfills the two barrier requirement and does not involve a wireline intervention.

In addition, the reliability and safety of each pressure barrier mechanism used in a subsea completion is highly critical. The accidental or inadvertent opening or closing of any of the pressure barrier mechanisms can result in a dangerous situation to personnel and equipment. Such accidental and inadvertent activations can be the result of leak paths formed in the mechanisms. It would thus also be beneficial to provide a pressure barrier mechanism that remains in its current position (either open or closed) despite the development of a leak path therein.

Also of relevance, lubricators can be used to add or remove sections from a tool string. It would be beneficial to provide a pressure barrier mechanism that could also be used as a downhole lubricator.

DETAILED DESCRIPTION

Figure 1A:
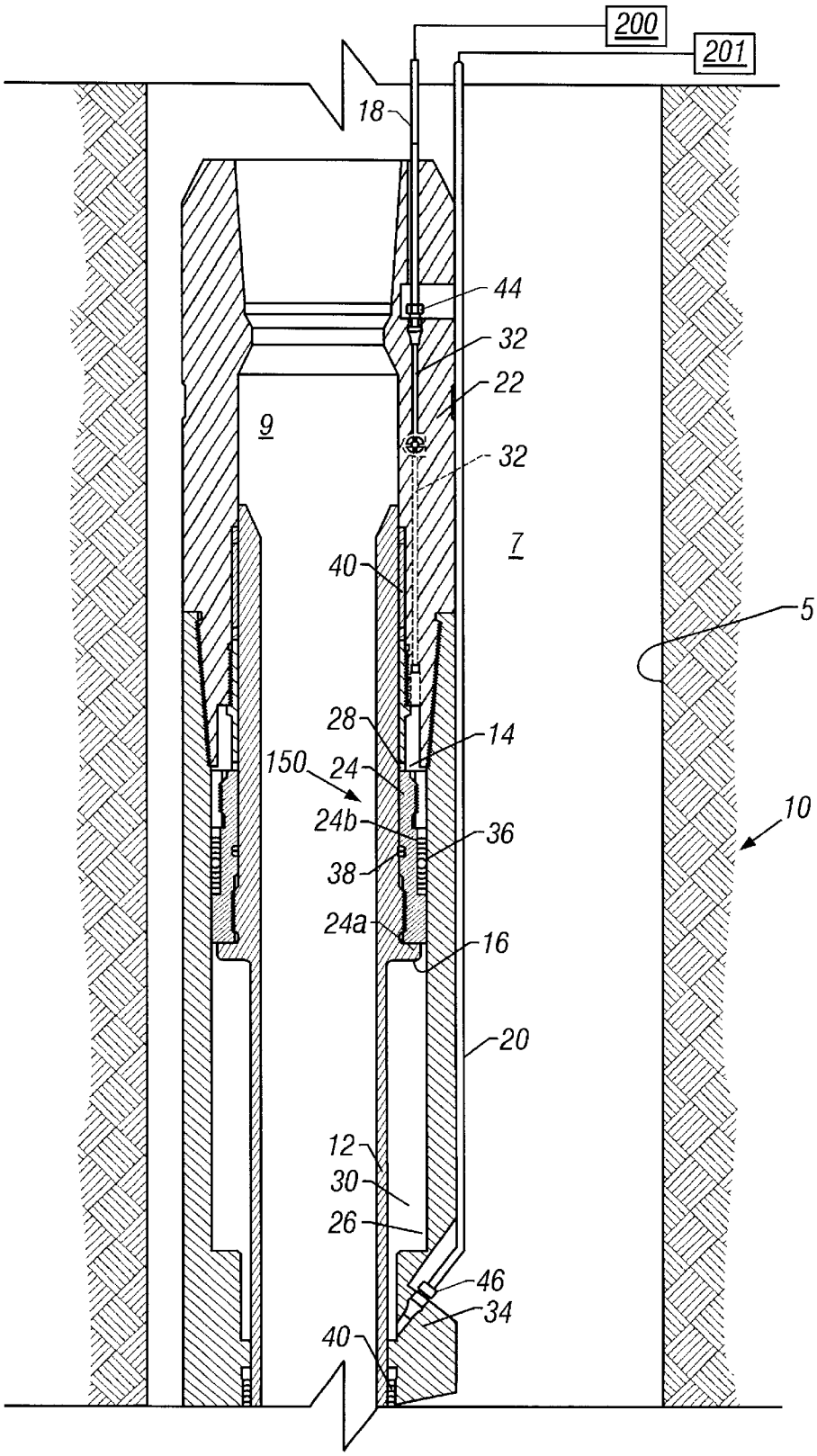
FIGS. 1A–1C are a cross-sectional view of a first embodiment of the tool of this invention.

In the following description, numerous details are set forth to provide an understanding of the present invention. However, it is to be understood by those skilled in the art that the present invention may be practiced without these details and that numerous variations or modifications from the described embodiments may be possible.

My invention comprises an isolation valve 10 disposed in a wellbore 5, the valve 10 being controlled from the surface and holding pressure from both its topside and underside. Valve 10 can be installed below the tubing hanger of the wellbore 5 as part of the remainder of the completion string. The valve's activating mechanism 150 ensures that the valve

10 fails in its current position and comprises an activating member 12 that includes at least one first surface 14 in fluid communication with a first source of hydraulic pressure 200 and at least one second surface 16 in fluid communication with a second source of hydraulic pressure 201. In one embodiment, the first surface 14 surface area is equal to the second surface 16 surface area. The first source of hydraulic pressure 200 is in fluid communication with the first surface 14 of the activating member 12 through a first control line 18 (from the surface). Application of hydraulic fluid on the first surface 14 moves the activating member 12 in a first direction. The second source of hydraulic pressure 201 is in fluid communication with the second surface 16 of the activating member 12 through a second control line 20 (from the surface). Application of hydraulic fluid on the second surface 16 moves the activating member 12 in a second direction. When applying pressure through first control line 18, it may be necessary to bleed second control line 20 in order to move activating member 12 in the first direction. When applying pressure second control line 20, it may be necessary to bleed first control line 18 in order to move activating member 12 in the second direction. The movement of the activating member 12, in turn, eventually changes the state of valve member 11 (by opening or closing valve member 11), which is shown to be a ball valve in the Figures, but may comprise any number of acceptable valves such as flapper valves, disk valves, and/or sleeve valve. Ball member 11, when in the closed position as shown in FIGS. 1A–1C, may selectively engage seals 210 to hold pressure from above and below.

Figure 1B:
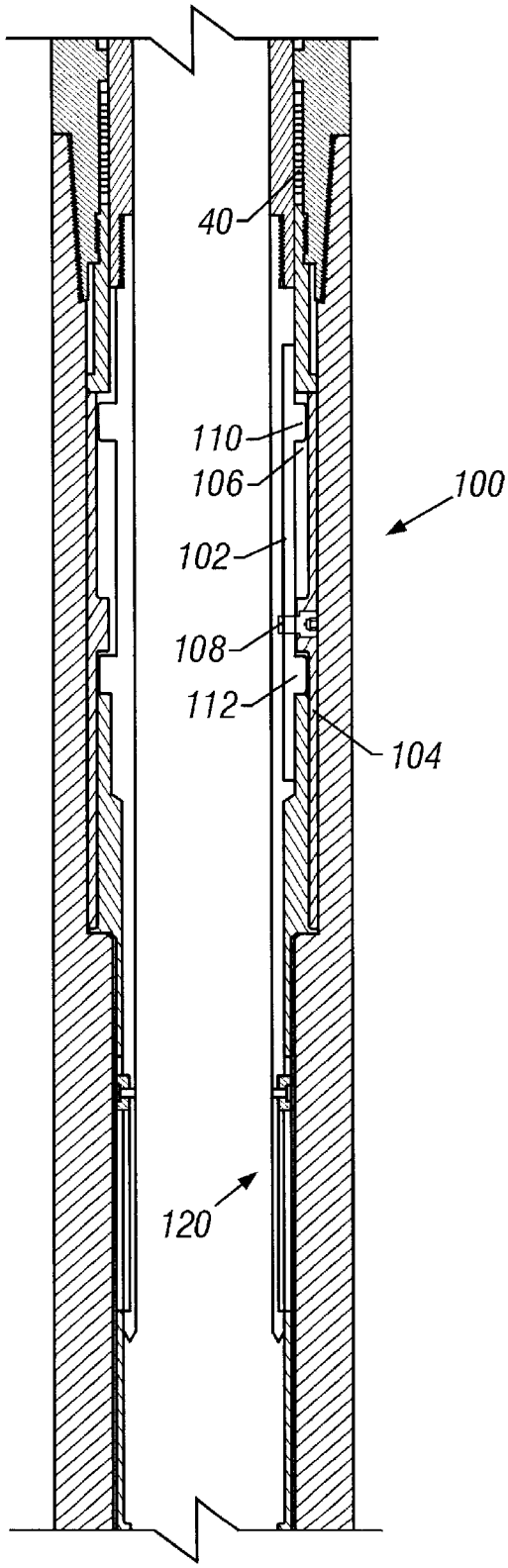
Figure 1C:
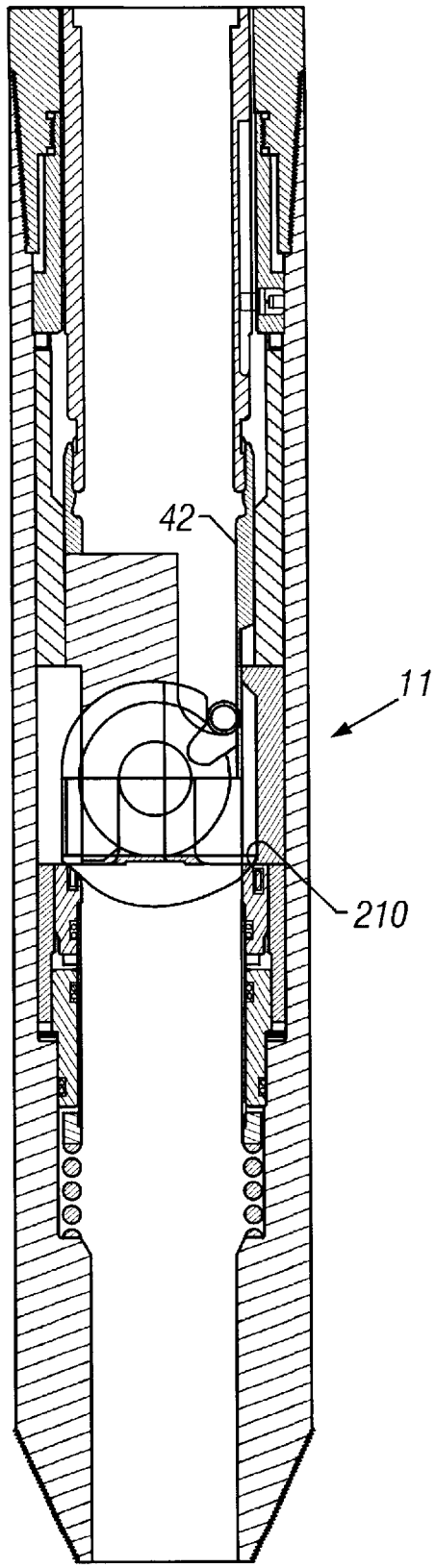
Figure 4:
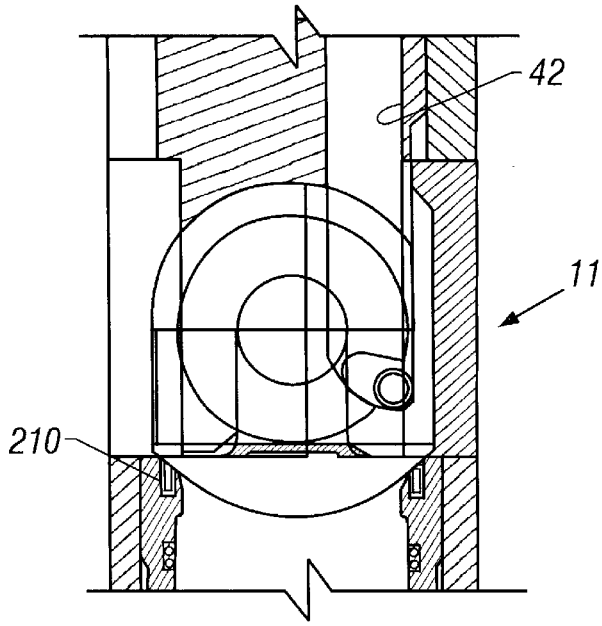
FIG. 4 is a schematic of the valve member in the open position.

By way of example, FIGS. 1A–1C show valve member 11 in the closed position. Application of hydraulic fluid on first surface 14 of activating member 12 through first control line 18 (and perhaps by also bleeding second control line 20) moves activating member 12 in the downward direction, thereby eventually opening valve member 11 (as schematically shown in FIG. 4). Thereafter, application of hydraulic fluid on second surface 16 of activating member 12 through second control line 20 (and bleeding of first control line 18) moves acticating member 12 in the upward direction, thereby eventually closing valve member 11 (returning it to the position shown in FIGS. 1A–1C).

The hydraulic fluid contained in the first source of hydraulic pressure 200 and the second source of hydraulic pressure 201 is the same density as, and may be the same fluid as, the fluid found in the annulus 7 of the wellbore 5. If either the first control line 18 or the second control line 20 develops a leak, fluid from the annulus 7 will likely migrate into valve 10 and act against the first surface 14 or the second surface 16 of the activating member 12. However, since the fluid in the annulus 7 is at least the same density as (and may be the same fluid as) the fluid in both control lines 18 and 20, the force exerted by the annulus 7 fluid on the first or second surface, 14 or 16, will not move the activating member 12 and will therefore not activate the valve member 11 (when no pressure is applied through first and second control lines 18 or 20). It is noted that in the static position (no pressure applied through control lines 18 or 20), each surface 14 and 16 sees only the hydrostatic pressure of the fluid within its respective control line 18 or 20, which is the same as the hydrostatic pressure of the annulus 7 fluid at each surface 14 and 16. The activating member 12 thus remains balanced despite the development of a leak path from the annulus 7. Thus, the valve 10 fails "safe" in its then current position despite the development of such leak paths.

The valve 10 may also include an indexing mechanism 100 requiring more than one operation (or pressure cycle) of the activating member 12 to open or close the valve member 11. This requirement further prevents the valve member 11 from accidentally opening or closing even if the activating member 12 is somehow moved once.

Activating mechanism 150 may also be used to activate downhole tools other than valve 10, such as but not limited to packers, sliding sleeves, and liner hangers.

Figure 3A:
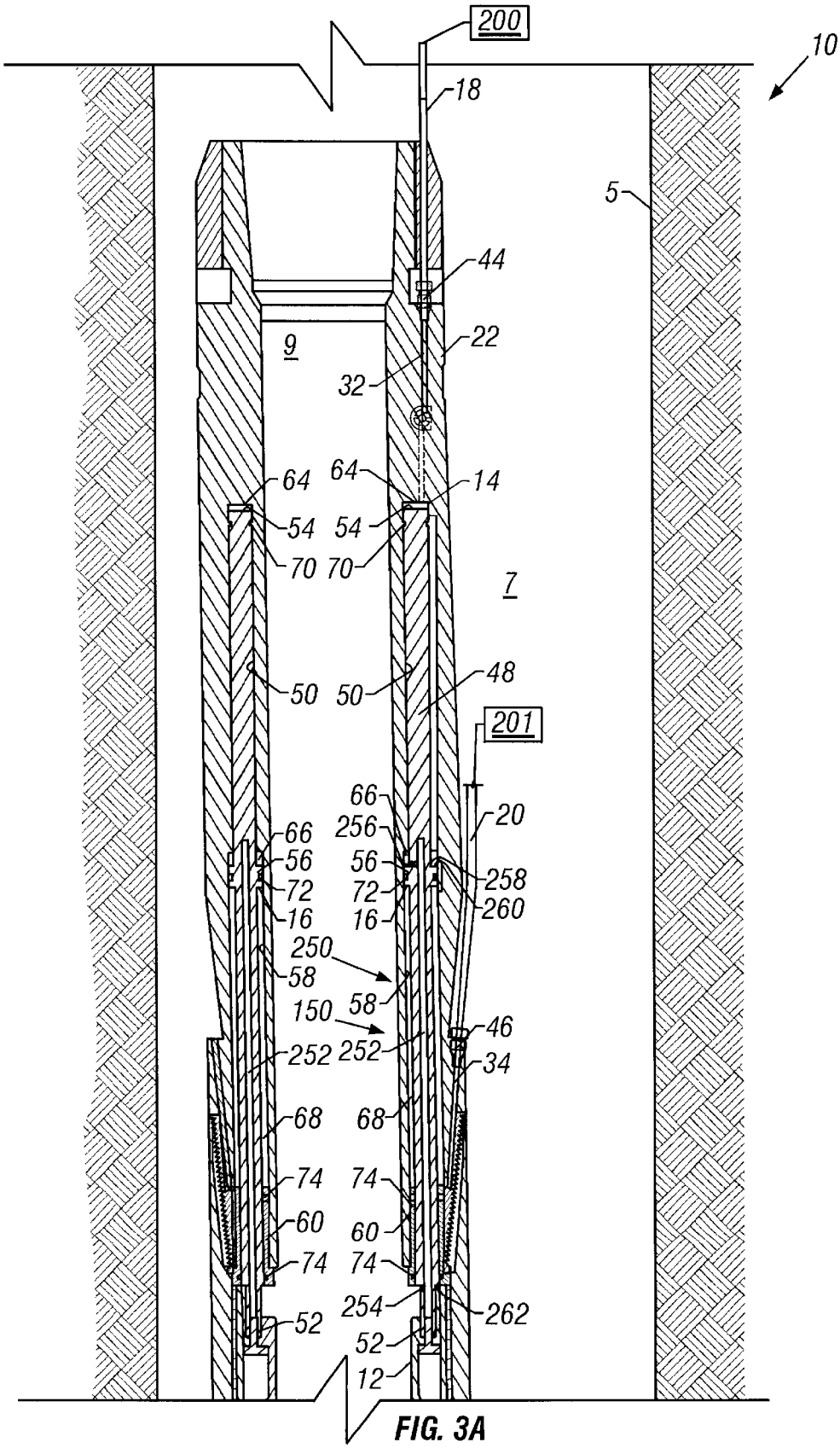
FIGS. 3A–3C are a cross-sectional view of a second embodiment of the tool of this invention.
Figure 3B:
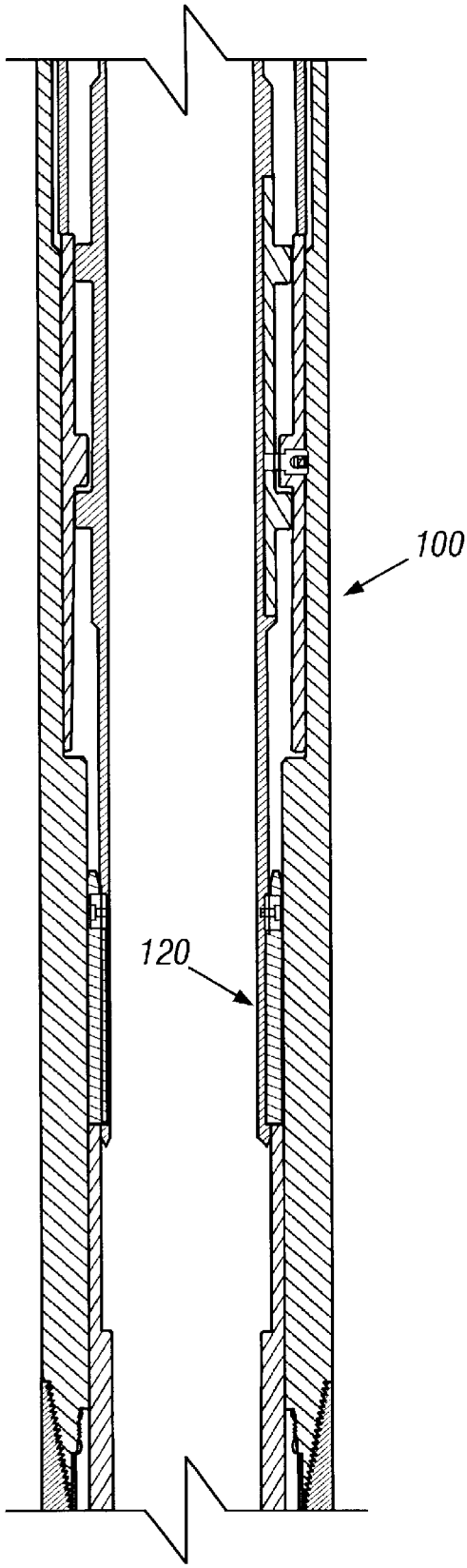
Figure 3C:
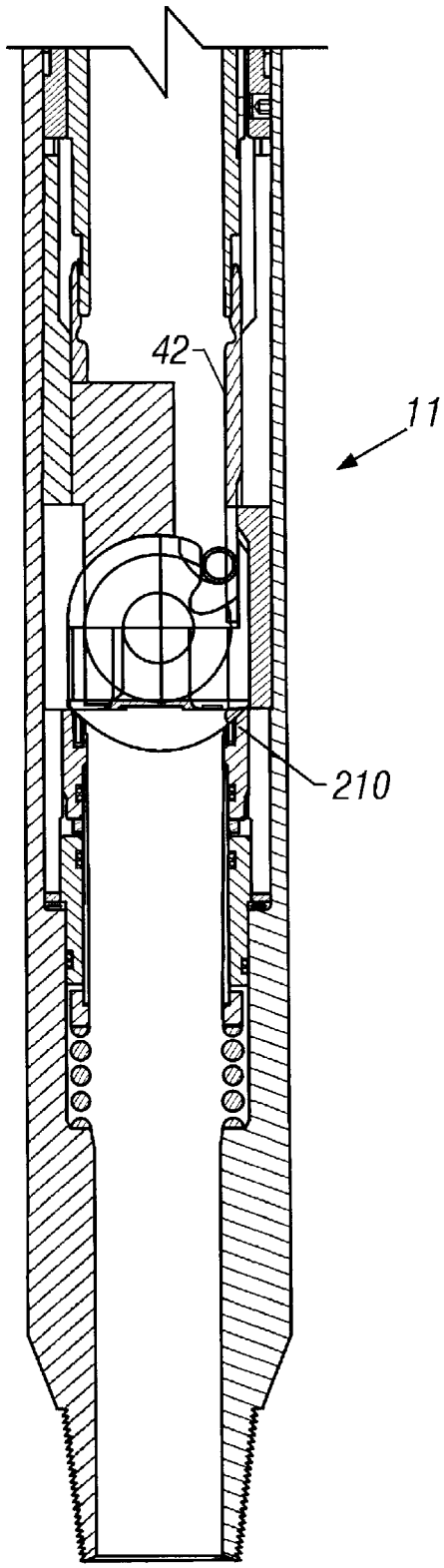

There are two primary embodiments of the valve 10 and the activating mechanism 150: the first is shown in FIGS. 1A–1C and the second is shown in FIGS. 3A–3C.

First Embodiment

Turning to FIGS. 1A–1C, activating member 12 is disposed within a mandrel 22 and includes an annular piston 24 that has the first surface 14 and the second surface 16 on opposing sides thereof. Mandrel 22, as shown in the figures, may be constructed from a plurality of sections attached to each other, such as by threading. As previously disclosed, in one embodiment, the first surface 14 surface area is equal to the second surface 16 surface area. Annular piston 24 is slidably disposed within a groove 26 in mandrel 22 and divides groove 26 into a first chamber 28 and a second chamber 30. First control line 18 is in fluid communication with first chamber 28 through a first port 32 in mandrel 22. Second control line 20 is in fluid communication with second chamber 30 through a second port 34 in mandrel 22. A chamber seal 36 is disposed between annular piston 24 and mandrel 22 so as to prevent fluid communication between first chamber 28 and second chamber 30. Annular piston 24, as shown in the Figures, may also be divided into two parts: an integral part 24*a* that is integral to activating member 12 and a separate part 24*b* that is releasably connected (such as by threads) to the activating member 12 and abuts the integral part 24*a*. In the embodiment including integral and separate parts, a chamber seal 38 is also disposed between separate part 24*b* and activating member 12 so as to prevent fluid communication between first chamber 28 and second chamber 30. In addition, to ensure that fluids within the bore 9 of the valve 10 do not migrate into either first chamber 28 or second chamber 30, a tubing seal 40 is disposed between activating member 12 and mandrel 22 both above first chamber 28 and below second chamber 30.

Upon application of pressure in first control line 18, hydraulic fluid flows from first control line 18 into first chamber 28 and acts against the first surface 14 of activating member 12. Hydraulic fluid within first chamber 28 is prevented from migrating into second chamber 30 by chamber seals 36 and 38 and is prevented from migrating into bore 9 by tubing seals 40. If sufficient pressure is applied to first surface 14, activating member 12 eventually moves in the first or downward direction. It is noted that it may be necessary to bleed second control line 20 in order to move activating member 12 in the first direction. At its lower end 42, activating member 12 is functionally attached to the valve member 11. Movement of the activating member 12 in the downward direction therefore eventually causes the valve member 11 to open, although downward movement may close the valve in other embodiments.

When it is desired to move activating member 12 in the second direction, first control line 18 is bled off and pressure is applied through second control line 20. Upon application of pressure in second control line 20, hydraulic fluid flows from second control line 20 into second chamber 30 and acts against the second surface 16 of activating member 12. Hydraulic fluid within second chamber 30 is prevented from migrating into first chamber 28 by chamber seals 36 and 38 and is prevented from migrating into bore 9 by tubing seals 40. If sufficient pressure is applied to second surface 16, activating member 12 eventually moves in the second or upward direction. Movement of the activating member 12 in the upward direction eventually causes the valve member 11 to close, although upward movement may open the valve in other embodiments.

Thereafter, activating member 12 can be moved again in the first direction by bleeding off second control line 20 and applying pressure in first control line 18. The cycle (first direction—second direction, or second direction—first direction) may be repeated by alternatingly bleeding and pressurizing first and second control lines 18 and 20, as discussed above.

Fluid in the annulus 7 may migrate into the first chamber 28 either by the development of a leak path in the first control line fittings 44 or by a failure of the first control line 18. If annulus 7 fluid enters the first chamber 28, the annulus 7 fluid will act on the first surface 14. However, since [i] the surface area of the first surface 14 is equal to the surface area of the second surface 16, [ii] the fluid in the annulus 7 is the same density as (and may be the same fluid as) the fluid in the first control line 18 and the second control line 20, and [iii] the hydrostatic pressure of the fluid in the first control line 18 at the first surface 14 is the same as the hydrostatic pressure of the annulus 7 fluid at the same surface, the action of the annulus 7 fluid on the first surface 14 does not by itself move the annular piston 24. Therefore, in the static position (no pressure applied through control lines 18 or 20), the activating member 12 also does not move and the migration of annulus 7 fluid into the first chamber 28 does not by itself result in the activation of the valve member 11. Valve 10 thus fails "safe" in its then current position despite a leak in first control line 18.

Fluid in the annulus 7 may also migrate into the second chamber 30 either by the development of a leak path in the second control line fittings 46 or by a failure of the second control line 20. If annulus 7 fluid enters the second chamber 30, the annulus 7 fluid will act on the second surface 16. However, since [i] the surface area of the second surface 16 is equal to the surface area of the first surface 14, [ii] the fluid in the annulus 7 is the same density as (and may be the same fluid as) the fluid in the first control line 18 and the second control line 20, and [iii] the hydrostatic pressure of the fluid in the second control line 18 at the second surface 16 is the same as the hydrostatic pressure of the annulus 7 fluid at the same surface, the action of the annulus 7 fluid on the second surface 16 does not by itself move the annular piston 24. Therefore, the activating member 12 also does not move and the migration of annulus 7 fluid into the second chamber 30 does not by itself result in the activation of the valve member 11. Valve 10 thus fails "safe" in its then current position despite a leak in second control line 20.

It is noted that as described valve 10 will fail "safe" in its then current position, which may be an open, closed, or intermediate (between fully open and fully closed) position, regardless of whether a leak is developed in the first and/or second control lines 18 and 20.

Although not necessary, valve 10 may also include an indexing mechanism 100 (as shown in the figures) which ensures that more than one pressure cycle of activating member 12 is necessary to open or close the valve member 11. Indexing mechanism 11 helps to ensure that valve member 11 will not be actuated (open or close) in case of seal or control line failure. Indexing mechanism 100 is functionally attached to the activating member 12 and may comprise a fixed indexer 102 and a rotating sleeve 104. Indexer 102 may be formed on or attached to activating member 12 and includes a plurality of slots 106 and a plurality of upper stops 110 and lower stops 112. Rotating sleeve 104 is rotatably disposed intermediate mandrel 22 and activating member 12 and includes a peg 108 that rides within slots 106 as will be disclosed herein.

Figure 2:
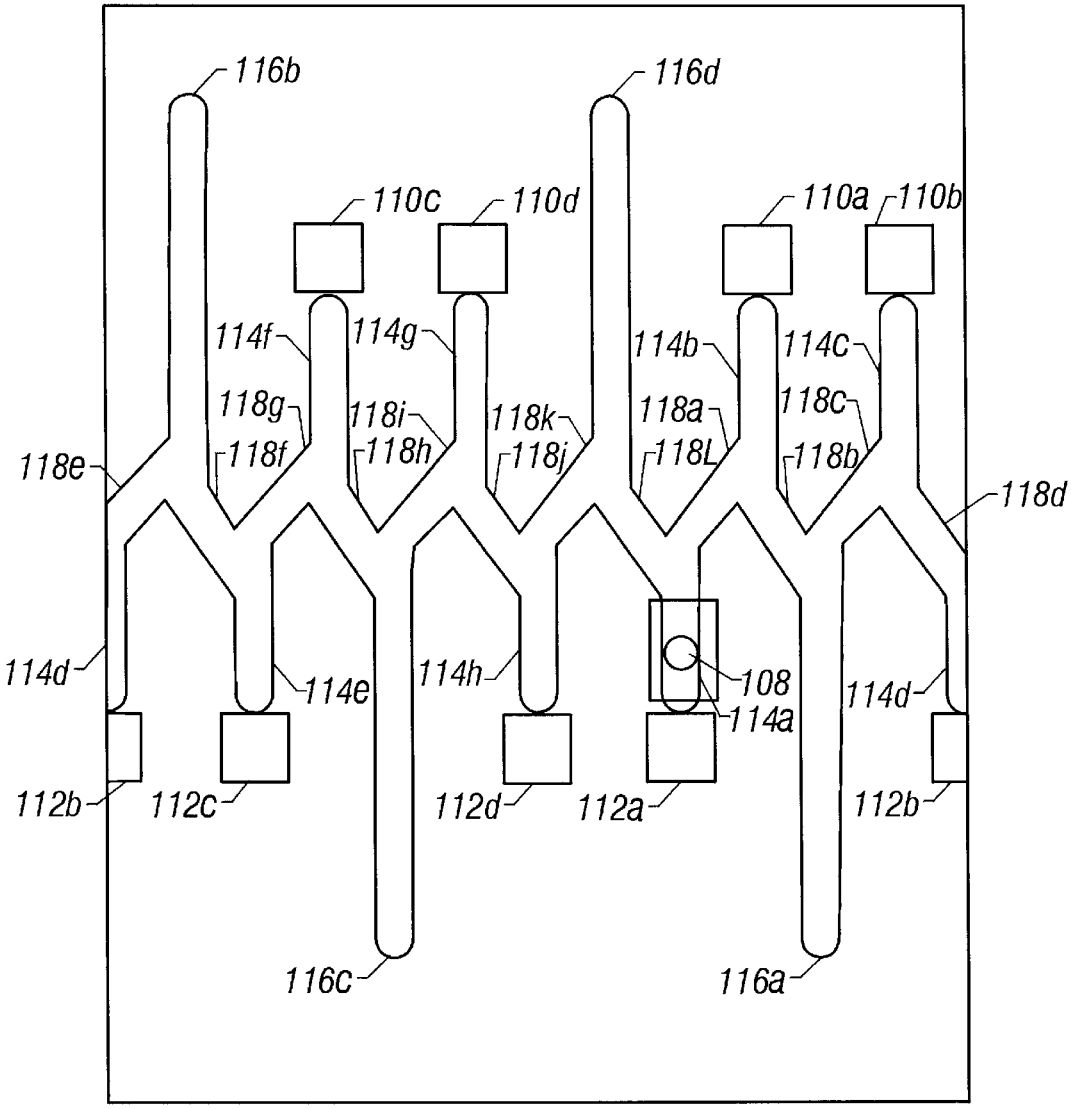
FIG. 2 is an unfolded view of one embodiment of the indexing mechanism of this invention.

FIG. 2 shows one embodiment of the indexer 102 and slots 106, with the indexer 102 being unfolded. FIG. 2 also shows the peg 108 and the upper and lower stops 110 and 112. Indexer 102 includes three types of slots 106: short slots 114, long slots 116, and transfer slots 118. It is assumed (only for purposes of illustration) that peg 108 is initially within short slot 114*a* and that it is prevented from further movement downward by lower stop 112*a*. Lower stop 112*a* is situated so that it does not enable activating member 12 to move downwardly enough to activate valve member 11.

Upon downward activation of activating member 12 (as previously disclosed), peg 108 rides upward on short slot 114*a* (as rotating sleeve 104 rotates) and, due to the respective angles, peg 108 enters transfer slot 118*a* first and then enters short slot 114*b*. Peg 108 continues within short slot 114*b* until it hits upper stop 110*a* which prevents further movement of activating member 12. Upper stop 110*a* is situated so that it does not enable activating member 12 to move downwardly enough to activate valve member 11. Specifically, activating member 12 also includes a lost action mechanism 120 (known in the field) which prevents the transfer of longitudinal movement to the lower end 42 of the activating member 12 when peg 108 remains within a short slot 114.

Upon upward activation of activating member 12 (as previously disclosed), peg 108 rides downwardly on short slot 114*b* (as rotating sleeve 104 rotates) and, due to the respective angles, peg 108 enters transfer slot 118*b* first and then enters long slot 116*a*. Long slot 116*a* does not have either an upper stop 110 or a lower stop 112; therefore, the activating member 12 is allowed to move upward sufficiently enough to activate valve member 11. Specifically, when peg 108 is in a long slot 116, lost action mechanism 120 enables the transfer of longitudinal movement to the lower end 42 of the activating member 12. The lower end 42 thus translates longitudinally thereby activating the valve member 11 (either open or closed).

Upon downward activation of activating member 12 (as previously disclosed), peg 108 rides upward on long slot 116*a* (as rotating sleeve 104 rotates) and, due to the respective angles, peg 108 enters transfer slot 118*c* first and then enters short slot 114*c*. Peg 108 continues within short slot 114*c* until it hits upper stop 110*b* which prevents further movement of activating member 12. Upper stop 110*b* is situated so that it does not enable activating member 12 to move downwardly enough to activate valve member 11. Specifically, the lost action mechanism 120 prevents the transfer of longitudinal movement to the lower end 42 of the activating member 12 when peg 108 remains within the short slot 114*c*.

Upon upward activation of activating member 12 (as previously disclosed), peg 108 rides downward on short slot 114*c* (as rotating sleeve 104 rotates) and, due to the respective angles, peg 108 enters transfer slot 118*d* first and then enters short slot 114*d*. Peg 108 continues within short slot 114*d* until it hits lower stop 112*b* which prevents further movement of activating member 12. Lower stop 112*b* is situated so that it does not enable activating member 12 to move upwardly enough to activate valve member 11. Specifically, the lost action mechanism 120 prevents the transfer of longitudinal movement to the lower portion 13 of the activating member 12 when peg 108 remains within the short slot 114*d*.

Upon downward activation of activating member 12 (as previously disclosed), peg 108 rides upwardly on short slot 114*d* (as rotating sleeve 104 rotates) and, due to the respective angles, peg 108 enters transfer slot 118*e* first and then enters long slot 116*b*. Long slot 116*b* does not have either an upper stop 110 or a lower stop 112; therefore, the activating member 12 is allowed to move upward sufficiently enough to activate valve member 11. Specifically, when peg 108 is in long slot 116*b*, lost action mechanism 120 enables the transfer of longitudinal movement to the lower portion 13 of the activating member 12. The lower portion 13 thus translates longitudinally thereby activating the valve member 11 (either open or closed).

The slot 10 configuration of the indexer 102 illustrated in the Figures results in the activation of valve member 11 every third pressure cycle. In other words, the illustrated indexer 102 includes two short slots 114 between each long slot 116 so that the operator must go through three pressure cycles to move the peg 108 into a long slot 116 and therefore activate the valve member 11. It is noted that the slot configuration can easily be changed so that the valve member 11 is activated at a different and desired number of pressure cycles. It is also noted that a different type of indexing mechanism 100, as known in the field (such as ratchets, keys, and collets), can be used to ensure that the valve member 11 is not activated (open or close) until the completion of a given number of pressure cycles.

In this first embodiment, it is further noted that, since the tubing seals 40 above and below the first and second chambers 28 and 30 are the same diameter, the activating member 12 is balanced to the bore 9 of the valve 10. Therefore, pressure fluctuations in the fluid disposed within bore 9 will not create movement in the activating member 12.

Second Embodiment

Turning to FIGS. 3A–3C, activating member 12 is disposed within a mandrel 22 and includes at least one rod piston 48, each rod piston 48 having the first surface 14 and the second surface 16 disposed thereon. As previously disclosed, the first surface 14 surface area may be equal to the second surface 16 surface area. In one embodiment, a plurality of rod pistons 48 are slidably disposed, each within a cylinder 50 defined in mandrel 22. At their lower ends 52, each rod piston 48 is fixedly attached to the remainder of the activating member 12 so that slidable movement of the rod pistons 48 generates longitudinal movement of the activating member 12. Intermediate their lower ends 52 and upper ends 54, each rod piston 48 also includes an annular extension 56 slidably disposed within an enlarged portion 58 of the cylinder 50. Within the enlarged portion 58 and proximate the rod piston lower ends 52, each cylinder 50 also includes a fitting 60 that is fixedly attached to the cylinder 50 and that receives the rod piston 48. First surface 14 is located on the upper end 54 of each rod piston 48, and second surface 16 is located on the annular extension lower end 62. A first chamber 64 is defined above each rod piston upper end 54. The annular extension 56 divides cylinder enlarged portion 58 into a third chamber 66 and a second chamber 68. A chamber seal 70 disposed proximate each rod piston upper end 54 between the rod piston 48 and the cylinder 50 prevents fluid communication between first chamber 64 and third chamber 66. A chamber seal 72 disposed between the annular extension 56 and the cylinder 50 prevents fluid communication between third chamber 66 and second chamber 68. Two chamber seals 74, one disposed between the fitting 60 and the cylinder 50 and one disposed between the fitting 60 and the rod piston 48, prevent fluid communication between the second chamber 68 and the bore 9 of the valve 10.

First control line 18 is in fluid communication with first chamber 64 through a first port 32 in mandrel 22. Second control line 20 is in fluid communication with second chamber 68 through a second port 34 in mandrel 22. To ensure that first control line 18 is in fluid communication with the first chamber 64 of each rod piston 48, a plurality of channels (not shown) are defined within mandrel 22 that provide fluid communication between all first chambers 64. To ensure that second control line 20 is in fluid communication with the second chamber 68 of each rod piston 48, a plurality of channels (not shown) are defined within mandrel 22 that provide fluid communication between all second chambers 68.

Upon application of pressure in first control line 18, hydraulic fluid flows from first control line 18 into all first chambers 64 and acts against the first surface 14 of each rod piston 48. Hydraulic fluid within first chamber 64 is prevented from migrating into third chamber 66 by chamber seal 70. If sufficient pressure is applied to first surface 14, rod pistons 48 and therefore activating member 12 eventually move in the first or downward direction. It is noted that it may be necessary to bleed off second control line 20 in order to move activating member 12 in the first direction. At its lower end 42, activating member 12 is functionally attached to the valve member 11. Movement of the activating member 12 in the downward direction therefore eventually causes the valve member 11 to open, although downward movement may close the valve in other embodiments.

When it is desired to move activating member 12 in the second direction, first control line 18 is bleed of and pressure is applied through second control line 20. Upon application of pressure in second control line 20, hydraulic fluid flows from second control line 20 into all second chambers 68 and acts against the second surface 16 of each rod piston 48. Hydraulic fluid within second chamber 68 is prevented from migrating into third chamber 66 by chamber seals 72 and is prevented from migrating into bore 9 by chamber seals 74. If sufficient pressure is applied to second surface 16, rod pistons 48 and therefore activating member 12 eventually moves in the second or upward direction. Movement of the activating member 12 in the upward direction eventually causes the valve member 11 to close, although upward movement may open the valve in other embodiments.

Thereafter, activating member 12 can be moved again in the first direction by bleeding off second control line 20 and applying pressure in first control line 18. The cycle (first direction—second direction, or second direction—first direction) may be repeated by alternatingly bleeding and pressurizing first and second control lines 18 and 20.

Fluid in the annulus 7 may migrate into the first chamber 64 either by the development of a leak path in the first control line fittings 44 or by a failure of the first control line 18. If annulus 7 fluid enters the first chamber 64, the annulus 7 fluid will act on the first surface 14. However, since [i] the surface area of the first surface 14 is equal to the surface area of the second surface 16, [ii] the fluid in the annulus 7 is the same density as (and may be the same fluid as) the fluid in the first control line 18 and the second control line 20, and [iii] the hydrostatic pressure of the fluid in the first control line 18 at the first surface 14 is the same as the hydrostatic pressure of the annulus 7 fluid at the same surface, the action of the annulus 7 fluid on the first surface 14 does not by itself move the rod piston 48. Therefore, the activating member 12 also does not move and the migration of annulus 7 fluid into the first chamber 64 does not by itself result in the activation of the valve member 11. Valve 10 thus fails "safe" in its then current position despite a leak in first control line 18.

Fluid in the annulus 7 may also migrate into the second chamber 68 either by the development of a leak path in the second control line fittings 46 or by a failure of the second control line 20. If annulus 7 fluid enters the second chamber 68, the annulus 7 fluid will act on the second surface 16. However, since the surface area of the second surface 16 is equal to the surface area of the first surface 14 and the fluid in the annulus 7 is the same density as (and may be the same fluid as) the fluid in the first control line 18 and the second control line 20, and [iii] the hydrostatic pressure of the fluid in the second control line 20 at the second surface 16 is the same as the hydrostatic pressure of the annulus 7 fluid at the same surface the action of the annulus 7 fluid on the second surface 16 does not by itself move the rod piston 48. Therefore, the activating member 12 also does not move and the migration of annulus 7 fluid into the second chamber 68 does not by itself result in the activation of the valve member 11. Valve 10 thus fails "safe" in its then current position despite a leak in second control line 20.

It is noted that as described valve 10 will fail "safe" in its then current position, which may be an open, closed, or intermediate (between fully open and fully closed) position, regardless of whether a leak is developed in the first or second control lines 18 and 20.

Each rod piston 48 may also include a balancing mechanism 250 that balances the rod piston 48 to the bore 9 of the valve 10 so that fluctuations in the pressure of the fluid in the bore 9 do not cause movement in rod piston 48. It is noted that each rod piston 48, proximate its lower end 52, is open to the bore 9. Therefore, without the balancing mechanism 250, the fluids in the bore 9 would act to move rod piston 48.

Balancing mechanism 250 comprises a channel 252 that may be defined in each rod piston 48. Channel 252 is in fluid communication with the bore 9 of the valve 10 via first channel port 254 and is in fluid communication with the third chamber 66 via second channel port 256. Thus, fluid from the bore 9 flows from the bore 9 into the third chamber 66. Within the third chamber 66, the fluid from the bore 9 acts on a third surface 258 defined on the upper end 260 of the annular extension 56. Fluid from the bore 9 also acts on a fourth surface 262 of the rod piston 48 externally of the cylinder 50. The surface area of the third surface 258 is equal to the surface area of the fourth surface 262. Therefore, the rod piston 48 is balanced to the fluid found within the bore 9 and pressure fluctuations in such fluid do not act to move the rod pistons 48 (or activating member 12).

The second embodiment may also include an indexing mechanism 100 and lost action mechanism 120 that function the same way as the indexing mechanism 100 and lost action mechanism 120 of the first embodiment.

In addition, either embodiment may include a profile defined on the activating member 12 which selectively mates with a profile defined on a shifting tool (not shown) deployed through the bore 9. The shifting tool may be used as a backup to the control lines 18 and 20 to mechanically shift the activating member 12 in order to change the state of the valve member 11. Furthermore, activating member 12, in either embodiment, and as shown in the figures and described herein may be constructed from a number of functionally attached components.

The valve 10 can therefore be used as one of the two mechanical pressure containment barriers required by safety regulations when the blow out preventer or tree of a wellbore is removed. The valve 10 can be opened or closed from the surface without well intervention and fails "safe" in its then current position in the event of a leak.

Figure 5:
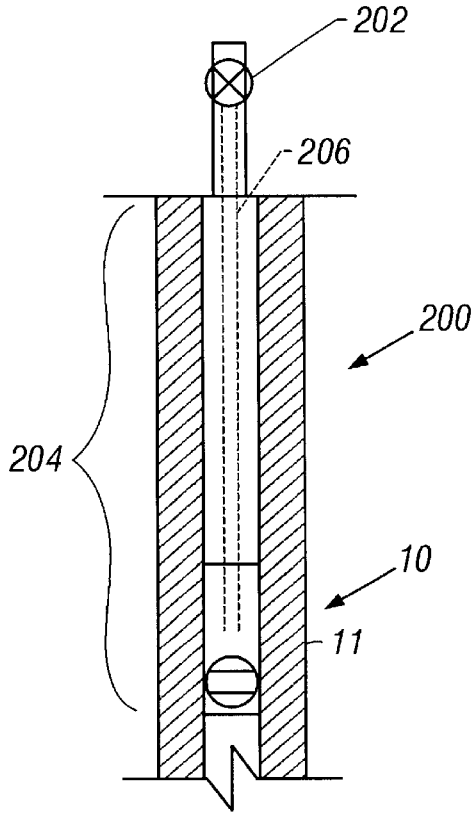
FIG. 5 is a schematic of the valve used as a downhole lubricator.

FIG. 5 shows the valve 10 used a lubricator 200. Valve member 11 may be closed (from the surface as disclosed herein) thereby isolating the pressure of the wellbore fluids underneath valve member 11. At this point, it is possible to open surface valve 202 to inject or insert a section of tubing 206 (which may include other tools), such as coiled tubing, into the completion 204. The length of the tubing section to be inserted can be varied by varying the distance between surface valve 202 and valve member 11. Thus, valve member 11 can be included further down the completion 204 in order to accommodate a longer length of tubing section 206. Once within the completion 204, the surface valve 202 can be opened, the valve member 11 can be opened (from the surface), and the tubing section 206 can be inserted under the wellbore fluid pressure to its destination.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. An activating mechanism for a downhole tool, the tool adapted to be deployed within a wellbore and a fluid filled annulus being defined intermediate the tool and the wellbore, comprising:

an activating member having a first surface and a second surface and adapted to change the state of the tool upon movement thereof;

a first source of hydraulic pressure in fluid communication with the first surface through a first control line;

a second source of hydraulic pressure in fluid communication with the second surface through the second control line; and the fluid supplied by the first source of hydraulic pressure and the second source of hydraulic pressure having the same density as the fluid disposed within the annulus of the wellbore; and wherein a leak in the first or second control line does not result in the movement of the activating member.

2. The activating mechanism of claim 1, wherein the fluid is supplied by the first source of hydraulic pressure and the second source of hydraulic pressure is the same fluid as the fluid disposed within the annulus of the wellbore.

3. The activating mechanism of claim 1, wherein the activating member is functionally attached to an indexing mechanism that requires more than one pressure cycle to change the state of the tool.

4. The activating mechanism of claim 3, wherein the indexing mechanism includes a lost motion mechanism.

5. The activating mechanism of claim 1, wherein:

the activating member includes an annular piston; and the annular piston includes the first surface and the second surface.

6. The activating mechanism of claim 5, wherein the first surface and the second surface are on opposite sides of the annular piston.

7. The activating mechanism of claim 6, wherein:

the annular piston sealingly divides a first chamber and a second chamber;

the first chamber includes the first surface and is in fluid communication with the first source of hydraulic pressure; and the second chamber includes the second surface is in fluid communication with the second source of hydraulic pressure.

8. The activating mechanism of claim 1, wherein:

the activating member includes at least one rod piston; and the at least one rod piston includes the first surface and the second surface.

9. The activating mechanism of claim 8, wherein:

the at least one rod piston is slidably disposed within a cylinder defined on the mandrel of the tool; and that at least one rod piston includes an annular extension slidably disposed within an enlarged portion of the cylinder.

10. The activating mechanism of claim 9, wherein:

the first surface is located on the upper end of the at least one rod piston; and the second surface is located on the lower end of the annular extension.

11. The activating mechanism of claim 10, wherein:

the cylinder is sealingly divided into at least a first chamber and a second chamber;

the first chamber includes the first surface and is in fluid communication with the first source of hydraulic pressure; and the second chamber includes the second surface and is in fluid communication with the second source of hydraulic pressure.

12. The activating mechanism of claim 11, wherein:

the cylinder further includes a third chamber sealingly isolated from the first and second chambers; and the third chamber is located intermediate the first surface and the annular extension.

13. The activating mechanism of claim 12, further comprises a balancing mechanism to balance the at least one rod piston to the bore of the tool.

14. The activating mechanism of claim 13, wherein the balancing mechanism comprises a channel defined in the at least one rod piston in fluid communication with the middle chamber and in fluid communication with the bore of the tool.

15. The activating mechanism of claim 14, wherein:

the at least one rod piston includes a third surface defined on the upper end of the annular extension and a fourth surface defined proximate to lower end of the at least one rod piston and in fluid communication with the bore of the too;

the third surface is located within the third chamber; and the surface area of the third surface is equal to the surface area of the fourth surface.

16. The activating mechanism of claim 1, wherein the activating member includes a balancing mechanism to balance the activating member to the bore of the tool.

17. The activating mechanism of claim 1, wherein the downhole tool comprises a valve.

18. The activating mechanism of claim 17, wherein the valve comprises a ball valve.

19. The activating mechanism of claim 17, wherein the valve holds pressure from above and from below.

20. The activating mechanism of claim 1, wherein the surface area of the first surface is equal to the surface area of the second surface.

21. The activating mechanism of claim 1, wherein application of fluid pressure from the first source to the first surface moves the activating member in a first direction changing the stare of the tool to a first state and application of pressure from the second source to the second surface moves the activating member in a second direction changing the state of the tool to a second state.

22. A downhole valve, the valve adapted to be deployed within a wellbore and an annulus being defined intermediate the valve and the wellbore, comprising:

an activating member having a first surface and a second surface;

the activating member adapted to change the state of the valve upon movement thereof;

a first control line in fluid communication with the first surface;

a second control line in fluid communication with the second surface; and the fluid disposed within the annulus of the wellbore being the same density as a fluid disposed within the first and second control lines in the absence of any leak in either the first control line or the second control line;

wherein a leak in the first or second control line does not result in the movement of the activating member.

23. The valve of claim 22, wherein the surface area of the first surface is equal to the surface area of the second surface.

24. The valve of claim 22, wherein application of fluid pressure from the first source to the first surface moves the activating member in a first direction changing the state of the tool to a first state and application of pressure from the second source to the second surface moves the activating member in a second direction changing the state of the tool to a second state.

25. The valve of claim 22, wherein the activating member is functionally attached to an indexing mechanism that requires more than one pressure cycle to activate the change the state of the valve.

26. A method for ensuring that an activating mechanism of a downhole tool fails in its then current position, comprising:

providing an activating member on the downhole tool, the activating member having a first surface and a second surface and adapted to change the state of the tool upon movement thereof;

deploying the downhole tool in the wellbore, a fluid-filled annulus being defined intermediate the tool and the wellbore;

communicating a first source of hydraulic pressure to the first surface through a first control line;

communicating a second source of hydraulic pressure to the second surface through a second control line; and supplying fluid from the first source of hydraulic pressure to the first surface and from the second source of hydraulic pressure to the second surface that is the same density as the fluid disposed within the annulus of the wellbore;

wherein a leak in the first or second control line does not result in the movement of the activating member.

27. The method of claim 26, wherein the surface area of the first surface is equal to the surface area of the second surface.

28. The method of claim 27, farther comprising bleeding the pressure applied by the second source against the second surface prior to applying fluid pressure from the first source to the first surface.

29. The method of claim 27, further comprising bleeding the pressure applied by the first source against the first surface prior to applying fluid pressure from the second source to the second surface.

30. The method of claim 26, comprising:

applying fluid pressure from the first source to the first surface to move the activating member in a first direction changing the state of the tool to a first state; and applying fluid pressure from the second source to the second surface to move the activating member in a second direction changing the state of the tool to a second state.

31. The method of claim 26, wherein the state of the tool is changed after a given number of pressure cycles between the first source and the second source.

32. A method for preventing the inadvertent activation of a downhole valve disposed in a wellbore having a fluid-filled annulus, comprising:

providing an activating member on the downhole valve, the activating member having a first surface and a second surface and adapted to change the state of the valve upon movement thereof;

communicating a first hydraulic fluid to the first surface through a first control line;

communicating a second hydraulic fluid to the second surface through a second control line; and supplying the first hydraulic fluid to the first surface and the second hydraulic fluid to the second surface so that each is the same density as the fluid disposed within the annulus of the wellbore;

wherein a leak in the first or second control line does not result in the movement of the activating member.

33. The method of claim 32, wherein the surface area of the first surface is equal to the surface area of the second surface.

34. The method of claim 32, further comprising:

applying fluid pressure from the first source to the first surface to move the activating member in a first direction changing the state of the tool to a first state; and applying fluid pressure from the second source to the second surface to move the activating member in a second direction changing the state of the tool to a second state.

35. The method of claim 34, further comprising bleeding the pressure applied by the second source against the second surface prior to applying fluid pressure from the first source to the first surface.

36. The method of claim 34, further comprising bleeding the pressure applied by the first source against the first surface prior to applying fluid pressure from the second source to the second surface.

37. The method of claim 32, wherein the state of the tool is changed after a given number of pressure cycles between the first source and the second source.

38. A downhole valve disposed within a wellbore having a fluid filled annulus defined intermediate the tool and the wellbore, comprising:

an activating member adapted to change the state of the valve upon movement thereof;

at least one source of hydraulic pressure in fluid communication with the activating member; and the fluid supplied by said at least one source of hydraulic pressure having the same density as the fluid disposed within the annulus of the well.

* * * * *